US005522539A

United States Patent [19]

Bazany

[11] Patent Number: 5,522,539

[45] Date of Patent: Jun. 4, 1996

[54] TOTE BOX WITH BLOCK INSERT LOCKING CAPABILITY

[75] Inventor: Donald J. Bazany, Grand Haven, Mich.

[73] Assignee: Bradford Company, Holland, Mich.

[21] Appl. No.: 357,717

[22] Filed: Dec. 16, 1994

[51] Int. Cl.[6] ..... B65D 5/44; B65D 5/50

[52] U.S. Cl. ..... 229/199; 206/523; 206/586; 220/410

[58] Field of Search ..... 229/199, 198.1; 206/523, 586, 589, 591; 220/400, 408, 410

[56] References Cited

U.S. PATENT DOCUMENTS

| | | | |
|---|---|---|---|
| 1,571,000 | 1/1926 | Eustis . | |
| 1,719,681 | 7/1929 | Wiebusch . | |
| 2,027,799 | 1/1936 | Wharton . | |
| 2,287,425 | 6/1942 | Fox . | |
| 2,665,808 | 1/1954 | McAlister . | |
| 2,989,189 | 6/1961 | Leone . | |
| 3,221,973 | 12/1965 | Kalbrener . | |
| 3,315,800 | 4/1967 | Wagner . | |
| 3,416,648 | 12/1968 | Levi | 206/523 |
| 3,701,465 | 10/1972 | Richter | 206/586 |
| 3,750,871 | 8/1973 | Cook | 206/523 |
| 4,241,832 | 12/1980 | Bliss . | |
| 4,610,355 | 9/1986 | Maurer | 206/523 |
| 4,953,705 | 9/1990 | Evany | 206/523 |
| 5,037,027 | 8/1991 | Nichols | 229/198.1 |
| 5,295,632 | 3/1994 | Zink et al. . | |
| 5,346,122 | 9/1994 | Leader et al. | 206/523 |
| 5,360,115 | 11/1994 | Makino | 206/523 |

FOREIGN PATENT DOCUMENTS

| | | | |
|---|---|---|---|
| 2631607 | 11/1989 | France | 206/523 |
| 6080183 | 3/1994 | Japan | 206/586 |
| 2041868 | 9/1980 | United Kingdom | 206/523 |

*Primary Examiner*—Gary E. Elkins
*Attorney, Agent, or Firm*—Wood, Herron & Evans

[57] ABSTRACT

A tote box made from a foldable corrugated plastic sheet blank is disclosed having block insert locking tabs to hold block inserts within the tote box secure against movement without use of any fasteners or adhesives. The block inserts are removable for subsequent reuse or replacement.

12 Claims, 4 Drawing Sheets

TOTE BOX WITH BLOCK INSERT LOCKING CAPABILITY

BACKGROUND OF THE INVENTION

This invention relates to tote boxes and, more particularly, to tote boxes made from foldable corrugated plastic sheet blanks and having inwardly projecting tabs to hold block inserts within the tote box secure against movement without the use of any fasteners or adhesives.

Various types of containers have been used in the past for shipping and storage of goods in commerce. One such container, which is reusable and commonly called a "tote box," is disclosed in U.S. Pat. No. 5,295,632, which is herewith incorporated herein by reference. In such a tote box, as in other containers used for shipping and storage, it is well known and a common practice to use block inserts for cushioning and spacing objects placed within the container. The block inserts are typically made of a material consisting of foam, plastic, rubber or wood, for example, and are generally positioned under or around the objects in the container to achieve the desired cushioning and spacing effects. In this way, the block inserts are provided to protect the objects within the container from damage caused by undesirable shock to or vibration of the container during use. However, with any block insert and container design, the block inserts are only effective when they are properly secured within the container and are properly registered with the objects to be protected. Thus, it is paramount for the protection of the objects that the block inserts do not shift or fall within the container during use.

Prior to the present invention, it has been the practice to either loosely fit the block inserts within the container or to use adhesives to either firmly attach the inserts to the container itself or to pads adapted to be fit within the container. One such block insert and container design is disclosed, for example, in Bliss, U.S. Pat. No. 4,241,832, wherein a wave shaped block insert of expanded polyethylene is either loosely wrapped around an object within the container or attached by an adhesive layer either to the container itself or to a pad adapted to be fit within the container. However, in typical containers of this kind, the loose block inserts are prone to shift during use, thereby compromising the desirable cushioning and spacing effect of the block inserts. Moreover, when the block inserts are glued to the container or to the pad, the block inserts cannot be easily removed and reused or replaced as may be desired. And very importantly, the block inserts, when glued or adhered to the container or pad of different material content, are difficult to recycle; a consideration which is becoming increasingly important.

Accordingly, it is a primary objective of the present invention to provide a tote box made from a novel corrugated blank and having block insert locking tabs to hold block inserts within the tote box secure against movement without the use of any fasteners or adhesives.

Another objective of this invention is to provide a tote box made from a corrugated blank and having block insert locking tabs to hold block inserts within the tote box secure against movement without the use of any fasteners or adhesives wherein the block inserts can be easily removed and subsequently reused or replaced as may be desired.

It is an additional objective of the present invention to provide a tote box made from a corrugated blank which, when fully folded and assembled, forms an integral rigid tote box having block insert locking tabs to hold block inserts within the tote box pad secure against movement without the use of any fasteners or adhesives.

SUMMARY OF THE INVENTION

The present invention is directed to a tote box which is assembled from, preferably, corrugated plastic sheet blanks and having a bottom, two side walls, and two end walls. The tote box of this invention includes a plurality of block insert locking tabs which are cut and folded inwardly into the tote box when it is fully folded and assembled. The tote box pad further includes at least two block inserts which are secured by the block insert locking tabs without the use of any adhesives or fasteners. In this way, the block inserts are removable from the tote box and replaceable or reusable as desired. The tote box of the present invention can thus be used, for example, by a parts supplier for shipping parts to a manufacturer for final assembly into a product and then returned to the supplier for reuse in a new shipment of parts.

In a first preferred embodiment of this invention, the bottom, end walls, and side walls of the tote box are joined to form an integral rigid tote box without the use of any mechanical fasteners. The tote box includes bottom tabs cut and folded upwardly from the bottom, end tabs cut and folded inwardly from the end walls, and side tabs cut and folded inwardly from the side walls. The block inserts include transverse slots through the block inserts for receiving the side tabs such that when the block inserts are inserted onto the side tabs, and between the side walls and the bottom and end tabs, the block inserts are secured against upward movement by the side tabs and against inward movement by the bottom and end tabs. Corner enhancers may be provided in each corner of the integral tote box to add structural rigidity. The corner enhancers each have two legs which are substantially normal to one another and are held in place between the end walls and the end flaps.

In a second embodiment of the present invention, a similarly folded and assembled tote box is provided having a bottom, two end walls, two side walls, and four end flaps which are extensions of the side walls. The bottom, end walls, side walls, and end flaps are joined to form an integral rigid tote box without the use of any mechanical fasteners. Bottom tabs are cut and folded upwardly from the bottom, end tabs are cut and folded inwardly from the end walls, and flap tabs are cut and folded inwardly from the end flaps. The tote box of the second preferred embodiment includes two block inserts having transverse slots through the block inserts at opposite ends thereof for receiving the flap tabs such that when the block inserts are inserted onto the flap tabs, and between the side walls and the bottom and end tabs, the block inserts are secured against upward movement by the flap tabs and against inward movement by the bottom and end tabs.

In the first and second preferred embodiments, a top rail may be further added to the tote box around an upper edge thereof to hold the erected tote box pad in an assembled relationship and to reinforce the top edge. The top rail includes a vertical lip on an outside edge thereof for facilitating stacking of a second tote box on top of the integral tote box.

In a third preferred embodiment, a tote box is disclosed having a generally U-shaped folded tote box pad which includes a bottom and two side walls. Bottom tabs are cut and folded upwardly from the bottom, and side tabs are cut and folded inwardly from the side walls such that the tote box pad is adapted to fit within a rigid tote tray. Two block inserts are provided having transverse slots through the block inserts for receiving the side tabs such that when the block inserts are inserted onto the side tabs, and between the side walls and the bottom tabs, the block inserts are secured against upward movement by the side tabs and against inward movement by the bottom tabs.

One advantage of each embodiment of the present invention is that the block inserts within the tote box can be secured without the use of any fasteners or adhesives. Another advantage of the present invention is that the block inserts are removable from the tote box for reuse or replacement as may be desired.

BRIEF DESCRIPTION OF THE DRAWINGS

The objectives and features of the present invention will come readily apparent when the following Detailed Description is taken in conjunction with the accompanying drawings in which.

DETAILED DESCRIPTION OF THE INVENTION

Figure 1:
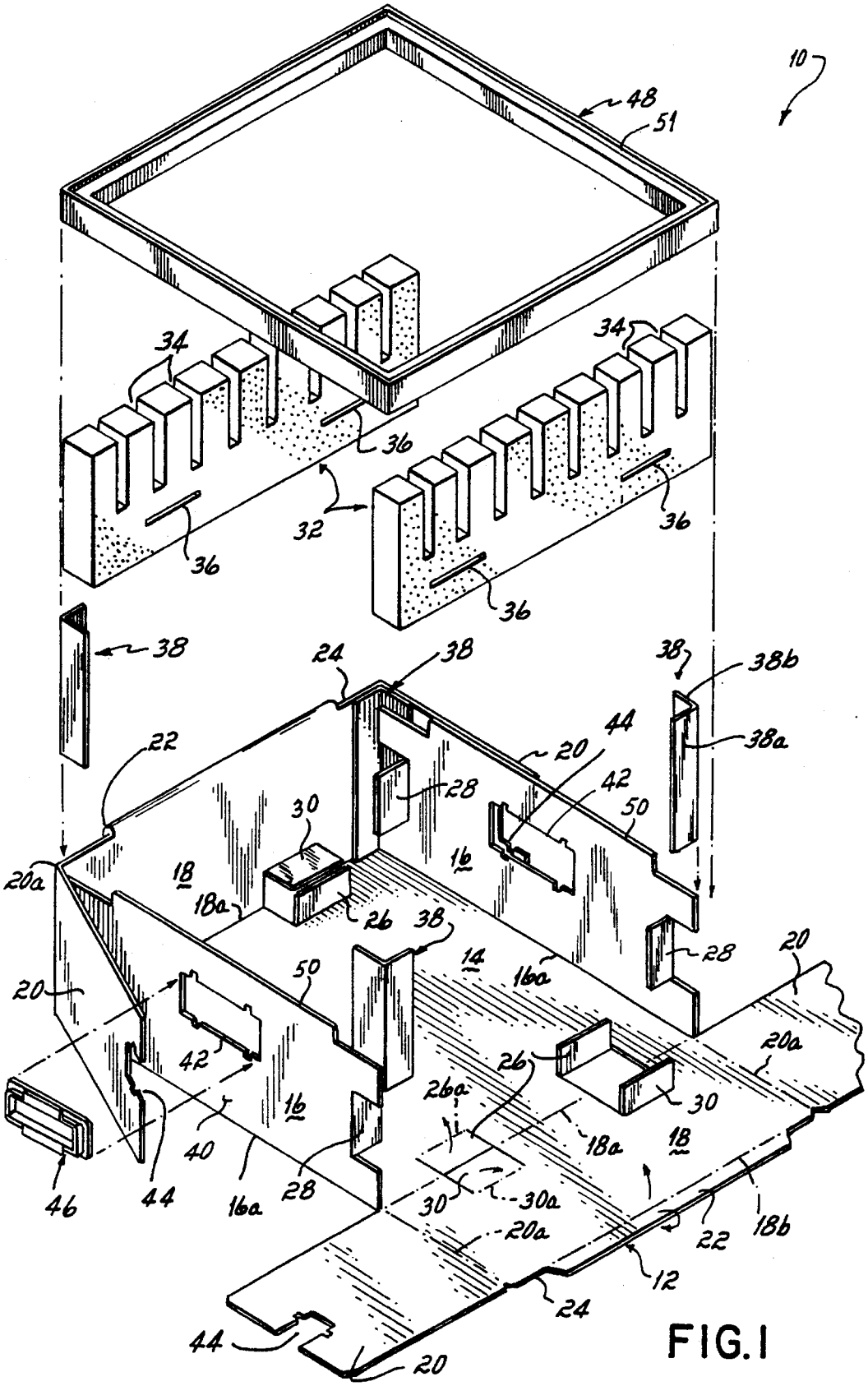
FIG. 1 is an exploded perspective view of a preferred embodiment of the tote box of the present invention.
Figure 2:
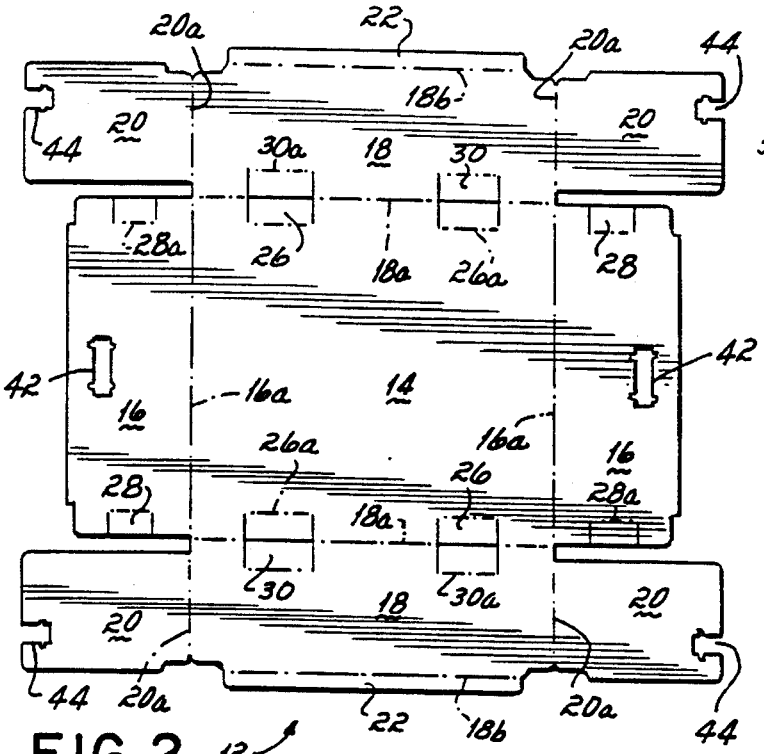
FIG. 2 is a top plan view of a blank used to form the tote box of FIG. 1.

With reference to FIGS. 1–4, a first preferred embodiment of a tote box 10 according to the present invention is shown. The tote box 10 is assembled from a uniform thickness single blank 12 (see FIG. 2) which is die cut, or otherwise precut from, preferably, corrugated plastic sheet. The blank 12 has a bottom 14, two end walls 16 connected to the bottom 14 by foldline 16*a*, two sidewalls 18 connected to the bottom 14 by foldlines 18*a*, and end flaps 20 which are lateral extensions of the sidewalls 18, and are connected thereto by foldlines 20*a*. The blank 12 also includes tabs 22 which are extensions of an uppermost edge 24 of the erected sidewall 18 and are connected to sidewalls 18 by foldlines 18*b*. The tabs 22 are downwardly folded onto the sidewalls 18 as shown in FIG. 1 for purposes to be described in more detail below. It will be appreciated that the terms "sidewall" and "end wall" are used herein for descriptive purposes only, and that these terms are completely interchangeable in the description of the present invention without departing from the spirit thereof.

In accordance with the present invention, the blank 12 includes bottom tabs 26 which are conventionally die cut into bottom 14 and hinged along foldlines 26*a*. The blank 12 further includes end tabs 28 die cut into the end walls 16 and hinged along foldlines 28*a*, and side tabs 30 die cut into sides 18 and hinged along foldlines 30*a*. In this way, tabs 26, 28, and 30 are adapted to be folded inwardly into the tote box 10 when it is fully folded and assembled as will be described in more detail below. The tote box 10 of the present invention includes two block inserts 32 made of foam, plastic, rubber or wood, for example, to be positioned under or around objects (not shown) within the tote box pad 10. The block inserts 32 include a plurality of skives 34 adapted to hold and space the objects. It will be appreciated that the skives 34 can be made any shape as required to hold and space the objects within the tote box 10 without departing from the spirit of the present invention. As shown in FIG. 1, block inserts 32 further include a plurality of transverse slots 36 through the block inserts 32 which are adapted to receive the side tabs 30 as will be described in more detail below.

With further reference to FIG. 1, four corner enhancers 38 are used in this preferred embodiment of the present invention. The corner enhancers 38 are preferably made of plastic or aluminum, and each corner enhancer 38 has two equal length legs 38*a* and 38*b*, which are substantially normal to one another and are of the height approximately equal to the height of the end walls 16 and sidewalls 18. The corner enhancers 38 are thusly adapted to reside in each corner of the tote box 10 when it is fully folded and assembled.

To assemble the tote box 10 of this preferred embodiment, the bottom tabs 26 are folded upwardly from the bottom 14 along the foldlines 26*a*, proximate and inward from each of the sidewalls 18. The end tabs 28 are folded inwardly from the end walls 16 along the foldlines 28*a*, proximate and inward from each of the sidewalls 18. Likewise, the side tabs 30 are folded inwardly from the sidewalls 18 along the foldlines 30*a*, proximate and inward from each of the sidewalls 18.

After the tabs 26, 28, and 30 have been folded inwardly, block inserts 32 are inserted onto the sidewalls 18 such that the side tabs 30 are received into the transverse slots 36 of block inserts 32. Once this has been accomplished, end walls 16 are first folded upwardly along foldlines 16*a* to an erect position substantially normal to the bottom 14. Next, the sidewalls 18 (and co-extensive block inserts 32) are folded upwardly along foldlines 18*a* to an erect position and the end flaps 20 are then folded along foldlines 20*a*, proximate outer surfaces 40 of the end walls 16. The end walls 16 have generally rectangular end holes 42, and the end flaps 20 each have an end flap cut out 44, which is essentially one-half of an end hole 42 so that when complimenting end flaps 20 are folded against the outer surfaces 40 of end walls 16, a hole identical in size to the end holes 42 is created whereupon a hand hold 46, preferably fabricated from plastic or aluminum, may be inserted therein.

While further description of the assembly of the tote box 10 will be described in brief, its details are clearly available from U.S. Pat. No. 5,295,632 which is incorporated herein by reference. Once the end walls 16 and the sidewalls 18 are folded upwardly and erect, the corner enhancers 38 are inserted into each corner of the fully folded tote box 10 and held in place between the end walls 16 and end flaps 20. The final step in the assembly of tote box 10 is accomplished by inserting a top rail 48 on a top edge 50 of the erected tote box 10. In this way, the fully folded and assembled tote box 10 forms an integral rigid tote box without the use of any mechanical fasteners. The top rail 48 includes a vertically extending lip 51 on an outside edge thereof to facilitate stacking of a second tote box in a nested relationship upon the rigid tote box of the present embodiment.

Figure 4:
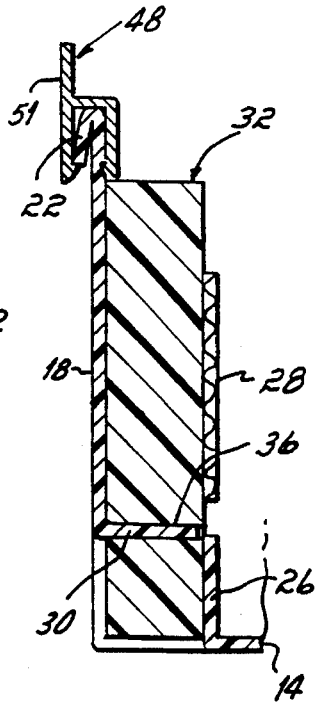
FIG. 4 is a cross-sectional view of a tote box wall taken on line 4—4 of FIG. 3.
Figure 3:
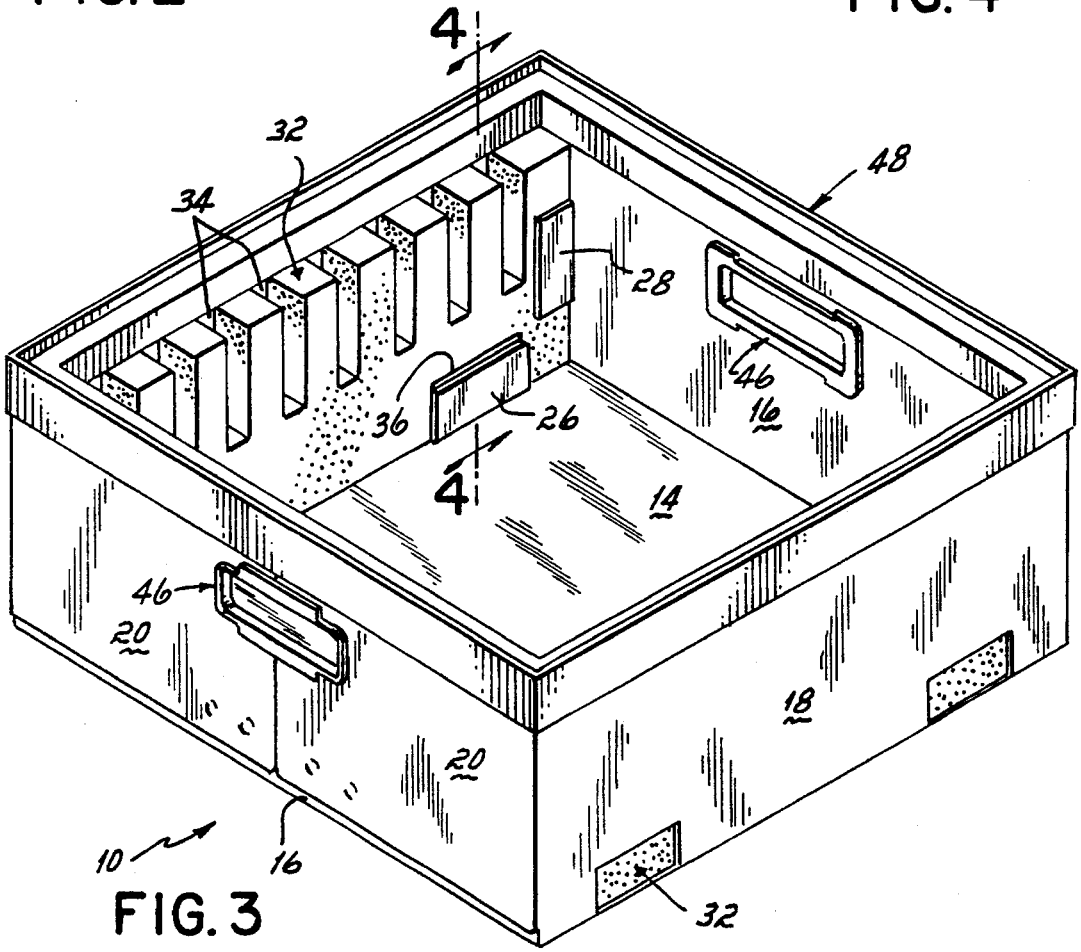
FIG. 3 is a perspective view of the assembled tote box of FIG. 1.

As shown in FIGS. 3 and 4, and in accordance with the present invention, the erected tote box 10 includes the two block inserts 32 (one shown) inserted onto the side tabs 30, and fit snugly between the sidewalls 18, and the bottom tabs 26 and end tabs 28. In this way, block inserts 32 are secured against upward movement by the side tabs 30 and against inward movement by the bottom tabs 26 and end tabs 28 without the use of any fasteners or adhesives.

Figure 5:
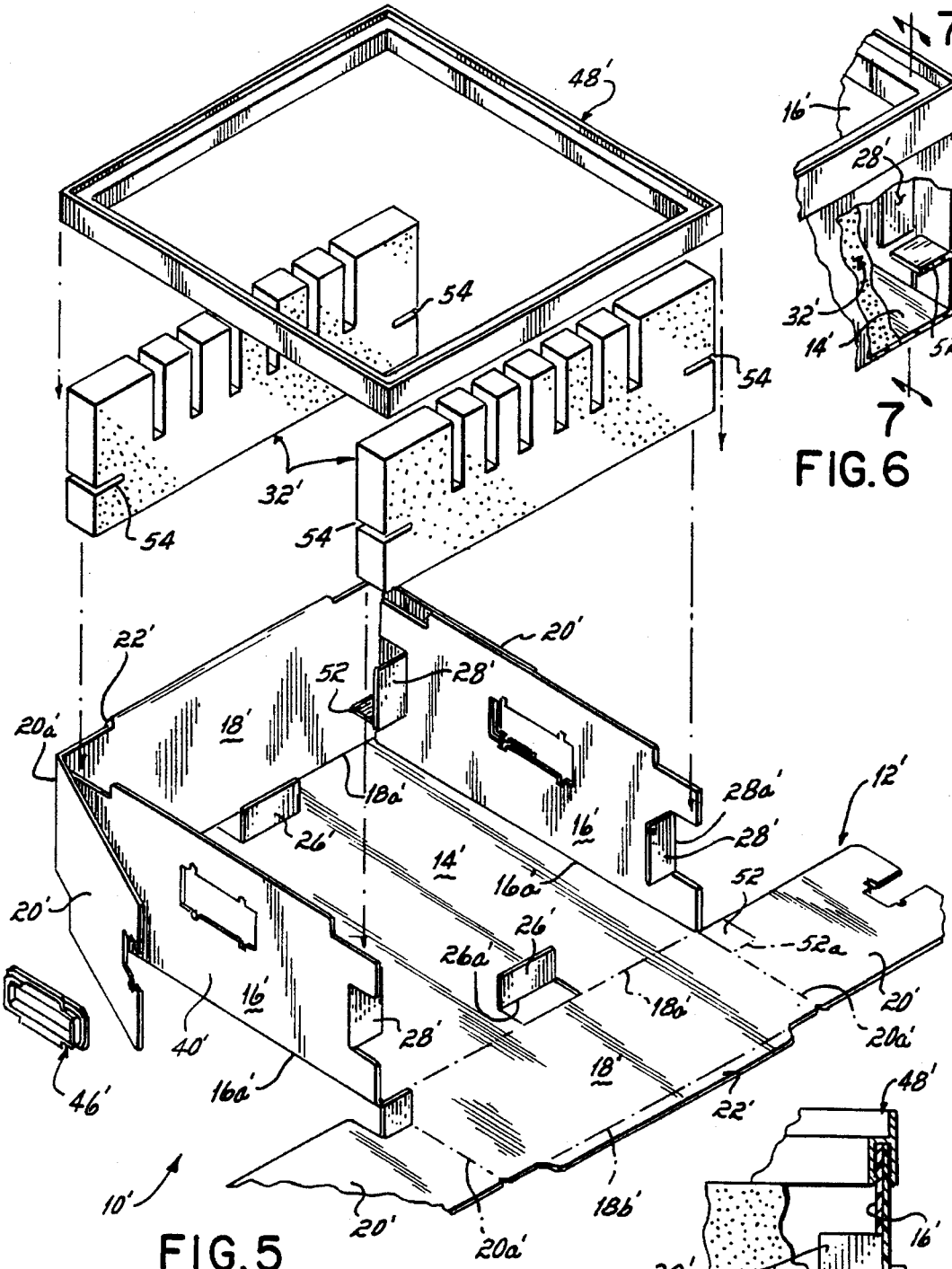
FIG. 5 is an exploded perspective view of a second preferred embodiment of the tote box of the present invention.
Figure 6:
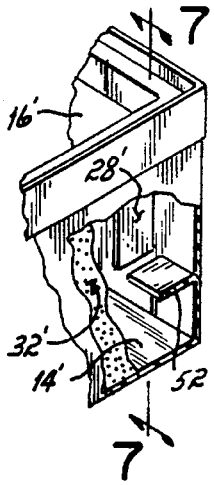
FIG. 6 is a partial perspective view of a corner of the tote box of FIG. 5 after it has been fully assembled.
Figure 7:
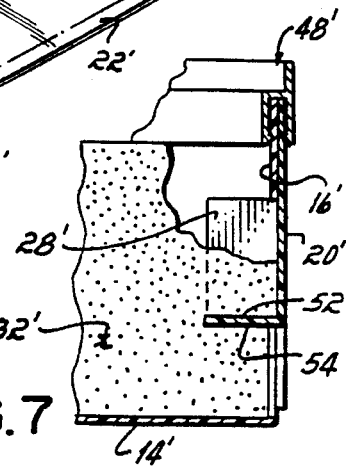
FIG. 7 is a cross-sectional view of the tote box corner of FIG. 6 taken on line 7—7.

A second preferred embodiment of the tote box according to the present invention is shown as tote box 10' in FIGS. 5–7. The tote box 10' is also preferably die cut or precut from corrugated plastic sheet, and is assembled in a similar fashion as the tote box 10 of FIG. 1 with several important differences to be described in more detail below.

Turning now to FIG. 5, the tote box 10' includes a bottom 14', two end walls 16' and two sidewalls 18'. The tote box 10' further includes bottom tabs 26' die cut into bottom 14' and hinged along foldlines **26*a*' and end tabs 28' die cut into end walls 16' and hinged along foldlines 28*a*'. In this second preferred embodiment, however, the side tabs 30 of the tote box 10 of FIG. 1 are dispensed with and a flap tab 52 is die cut into each end flap 20' and hinged along foldlines 52*a*. Tabs 26', 28' and 52 are thusly adapted to be folded inwardly into the tote box 10'** when it is fully folded and assembled as will be described in more detail below.

In accordance with the second preferred embodiment of the present invention, the tote box 10' of FIG. 5 further includes two block inserts 32' which are made of the same material and for the same purpose as the block inserts 32 of FIG. 1. In the second preferred embodiment of this invention, however, the transverse slots 36 of the block inserts 32 of FIG. 1 are dispensed with, and transverse slots 54 are provided at opposite ends of the block inserts 32' which are adapted to receive the flap tabs 52 as will be described in more detail below.

With further reference to FIG. 5, to assemble the tote box 10' of this second preferred embodiment, the bottom tabs 26' are folded upwardly from the bottom 14' along the foldlines **26*a*', proximate and inward from each of the sidewalls 18'. The end tabs 28' are folded inwardly from the end walls 16' along the foldlines 28*a*', proximate and inward from each of the sidewalls 18'. Likewise, the flap tabs 52 are folded inwardly from the end flaps 20' along the foldlines 52*a*, proximate and inward from each of the sidewalls 18'**.

To further assemble the tote box 10' of the second preferred embodiment, the end walls 16' are first folded upwardly along foldlines **16*a*' such that the end walls 16' stand erect and normal to the bottom 14'. Next, the block inserts 32' are inserted into the tote box 10' between the bottom tabs 26' and end tabs 28', and the unfolded sidewalls 18'. With the block inserts 32' in this erect position, the end flaps 20' are then folded upwardly from sides 18' along foldlines 20*a*' such that the end flaps 20' stand substantially normal to sidewalls 18'. In this way, sidewalls 18' are then folded upwardly along foldlines 18*a*' such that the flap tabs 52 are received into the transverse slots 54 of the block inserts 32'. The end flaps 20' are then completely folded along foldlines 20*a*', proximate outer surfaces 40' of the end walls 16'. Final assembly of the tote box 10' is accomplished by inserting hand holds 46' and top rail 48' in the same way as described with reference to the tote box 10 of FIG. 1**.

As shown in FIGS. 6 and 7, the erected tote box 10' includes the two block inserts 32' (one shown) inserted onto the flap tabs 52, and fit snugly between the sidewalls 18', and the bottom tabs 26' (not shown) and end tabs 28'. In accordance with the second preferred embodiment of the present invention, block inserts 32' are secured against upward movement by the flap tabs 52 and against inward movement by the bottom tabs 26' and end tabs 28' without the use of any fasteners or adhesives.

It will be appreciated by those skilled in the art that virtually any combination of bottom, end, side and flap tabs can be formed in the tote box 10 and 10' to hold the block inserts within the tote box secure against movement without the use of any fasteners or adhesives.

Figure 8:
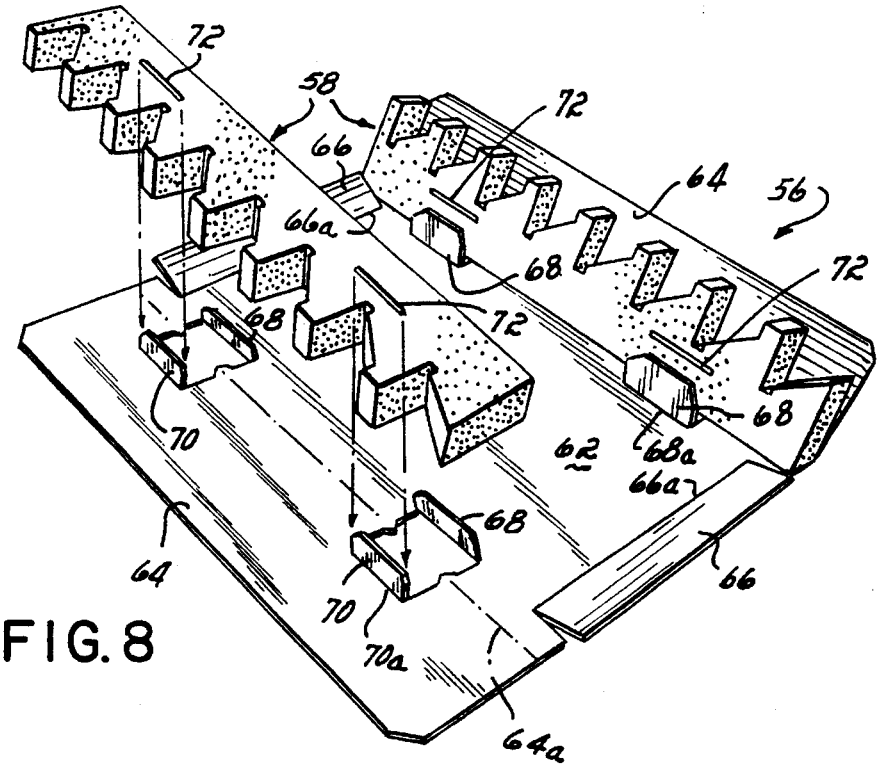
FIG. 8 is an exploded perspective view of a third preferred embodiment of the tote box of the present invention.
Figure 9:
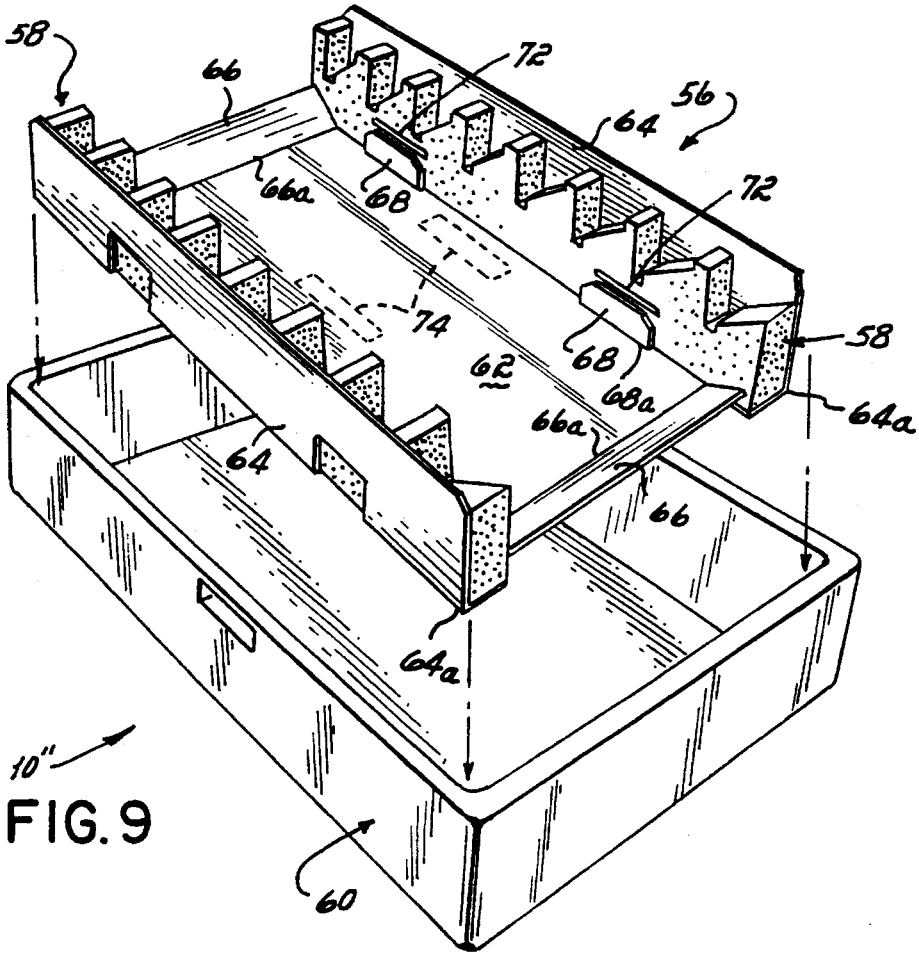
FIG. 9 is a perspective view of the assembled tote box of FIG. 8.

With reference now to FIGS. 8 and 9, a third preferred embodiment of the present invention is shown as a tote box 10" having a generally "U-shaped" tote box pad 56, two block inserts 58, and a rigid tray 60. The tote box pad 56, preferably made from a foldable corrugated plastic sheet blank, includes a bottom 62, two side walls 64 connected to the bottom 62 by foldlines **64*a*, and two end flaps 66 connected to bottom 62 by foldlines 66*a*. Bottom tabs 68 are cut into bottom 62 and hinged along foldlines 68*a*, and side tabs 70 are cut into sides 64 and hinged along foldlines 70*a*, whereby tabs 68 and 70 are adapted to be folded inwardly into the tote box pad 56 in accordance with the present invention. The two block inserts 58 include transverse slots 72 for receiving the side tabs 70 when the tote box pad 56 is fully assembled. The tray 60 is preferably made of a rigid material, including plastic, metal or other suitable material, which has sufficient durability for the intended use of the tote box 10". The tote tray 60 is further adapted to receive the tote box pad 56** as will be described in more detail below.

The tote box pad 56 of this third preferred embodiment is assembled by folding the bottom tabs 68 upwardly from the bottom 62 along foldlines **68*a*, proximate and inward from each of the sidewalls 64. Likewise, the side tabs 70 are folded inwardly from the sidewalls 64 along the foldlines 70*a*, proximate and inward from each of the sidewalls 64**.

With further reference to FIGS. 8 and 9, the block inserts 58 are then inserted onto the sidewalls 64 such that the side tabs 70 are received into the transverse slots 72 of block inserts 58. Next, the sidewalls 64 (and co-extensive block inserts 58) are folded upwardly along foldlines **64*a* and the end flaps 66 are folded upwardly along foldlines 66*a*. In this way, the final step in the assembly of the tote box 10" is accomplished by inserting the tote box pad 56 into the rigid tray 60. Preferably, the tote box pad 56 is attached to the rigid tray 60 by a plurality of double-sided adhesive tape strips 74 disposed between the bottom 62 of tote pad 56 and a bottom 74 of rigid tray 60. In accordance with the third preferred embodiment of the present invention, the block inserts 58 are secured against upward movement by the side tabs 70 and against inward movement by the bottom tabs 68**.

From the above disclosure of the general principles of the present invention and the preceding detailed description of the preferred embodiments, those skilled in the art will readily comprehend the various modifications to which the present invention is susceptible. Therefore, we desire to be limited only by the scope of the claims and equivalents thereof.

What is claimed is:

1. A tote box with block insert locking capability, comprising:

a uniform thickness foldable corrugated blank, said blank having a bottom, two end walls, and two side walls, said end walls and side walls being folded upwardly from said bottom such that said end walls and side walls stand erect, said end walls and side walls further being joined such that said folded blank forms an integral rigid tote box, said blank further having a plurality of first tabs cut and folded inwardly from at least one of said bottom and said end walls, said first tabs being folded proximate and inward from each of said side walls when said tote box is folded;

each of said side walls having at least one second tab cut and folded inwardly from said side wall, said second tabs being folded proximate and upward from said bottom; and a plurality of block inserts, each of said block inserts having at least one transverse slot through said block insert for receiving said second tabs, each of said block inserts cooperating with said first and second tabs such that when said block inserts are inserted onto said second tabs, and between said side walls and said first tabs, said block inserts are secured against upward movement within said tote box by said second tabs and against inward movement by said first tabs.

2. A tote box of claim 1 wherein said block inserts are made of a material of at least one of a group consisting of foam, plastic, rubber and wood.

3. A tote box of claim 1 further comprising four corner enhancers, one of which resides in each corner of said integral tote box.

4. A tote box of claim 1 further comprising a unitary top rail extending around a top edge of said tote box.

5. A tote box of claim 4 wherein said top rail has a vertical lip on an outside upper edge thereof for facilitating stacking of a second tote box on top of said integral tote box.

6. A tote box with block insert locking capability, comprising:

a uniform thickness foldable corrugated blank, said blank having a bottom, two end walls, and two side walls, said end walls and side walls being folded upwardly from said bottom such that said end walls and side walls stand erect, said end walls and side walls further being joined such that said folded blank forms an integral rigid tote box, said bottom having at least one bottom tab cut and folded upwardly from said bottom proximate and inward from each of said side walls, each of said side walls having at least one side tab cut and folded inwardly from said side wall proximate and upward from said bottom, and each of said end walls having a plurality of end tabs cut and folded inwardly from said end wall proximate and inward from each of said side walls when said blank is folded; and a plurality of block inserts, each of said block inserts having at least one transverse slot through said block insert for receiving said at least one side tab, each of said block inserts cooperating with said bottom, side, and end tabs such that when said block inserts are inserted onto said side tabs, and between said side walls and said bottom and end tabs, said block inserts are secured against upward movement within said tote box by said side tabs and against inward movement by said bottom and said end tabs.

7. A tote box with block insert locking capability, comprising:

a uniform thickness foldable corrugated blank, said blank having a bottom, two end walls, two side walls, and four end flaps which are extensions of said side walls, said end walls and side walls being folded upwardly from said bottom such that said end walls and side walls stand erect, said end walls, side walls and end flaps further being joined such that said folded blank forms an integral rigid tote box, said blank further having a plurality of first tabs cut and folded inwardly from at least one of said bottom and said end walls, said first tabs being folded proximate and inward from each of said side walls when said blank is folded;

each of said end flaps having a second tab cut and folded inwardly from said end flap proximate one of said side walls and upward from said bottom; and a plurality of block inserts, each of said block inserts having transverse slots through said block inserts at opposite ends thereof for receiving said second tabs, each of said block inserts cooperating with said first and second tabs such that when said block inserts are inserted onto said second tabs, and between said side walls and said first tabs, said block inserts are secured against upward movement within said tote box by said second tabs and against inward movement by said first tabs.

8. A tote box of claim 7 wherein said block inserts are made of a material of at least one of a group consisting of foam, plastic, rubber and wood.

9. A tote box of claim 7 further comprising four corner enhancers, one of which resides in each corner of said integral tote box.

10. A tote box of claim 7 further comprising a unitary top rail extending around a top edge of said tote box.

11. A tote box of claim 10 wherein said top rail has a vertical lip on an outside upper edge thereof for facilitating stacking of a second tote box on top of said integral tote box.

12. A tote box with block insert locking capability, comprising:

a rigid tote tray having a bottom, two end walls, and two side walls;

a U-shaped pad formed from a uniform thickness foldable corrugated blank and having a bottom and two side walls, said U-shaped pad being adapted to fit within said rigid tote tray, said bottom having at least one bottom tab cut and folded upwardly from said bottom proximate and inward from each of said side walls, and each of said side walls having at least one side tab cut and folded inwardly from said side wall proximate and upward from said bottom when said U-shaped pad is folded; and a plurality of block inserts, each of said block inserts having at least one transverse slot through said block insert for receiving said at least one side tab, each of said block inserts cooperating with said bottom and said side tabs such that when said block inserts are inserted onto said side tabs, and between said side walls and said bottom tabs, said block inserts are secured against upward movement within said tote box by said side tabs and against inward movement by said bottom tabs.

* * * * *